US010443180B2

(12) United States Patent
Lee et al.

(10) Patent No.: US 10,443,180 B2
(45) Date of Patent: Oct. 15, 2019

(54) LAUNDRY TREATMENT APPARATUS

(71) Applicant: LG Electronics Inc., Seoul (KR)

(72) Inventors: Seungjoon Lee, Seoul (KR); Namyeong Heo, Seoul (KR); Chungil Kim, Seoul (KR); Junghoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 659 days.

(21) Appl. No.: 15/042,818

(22) Filed: Feb. 12, 2016

(65) Prior Publication Data

US 2016/0237613 A1 Aug. 18, 2016

(30) Foreign Application Priority Data

Feb. 16, 2015 (KR) ..... 10-2015-0023094
Feb. 16, 2015 (KR) ..... 10-2015-0023103
Mar. 2, 2015 (KR) ..... 10-2015-0028900

(51) Int. Cl.
*D06F 58/22* (2006.01)
*D06F 25/00* (2006.01)

(52) U.S. Cl.
CPC ..... *D06F 58/22* (2013.01); *D06F 25/00* (2013.01)

(58) Field of Classification Search
CPC ..... F26B 25/007; D06F 58/22; D06F 25/00
See application file for complete search history.

(56) References Cited

FOREIGN PATENT DOCUMENTS

| | | | |
|---|---|---|---|
| CN | 101100802 | 1/2008 | |
| CN | 101451294 | 6/2009 | |
| CN | 103911801 | 7/2014 | |
| DE | 3329615 | 2/1985 | |
| EP | 2664706 | 10/2014 | |
| GB | 2048962 | 12/1980 | |
| JP | H08-257286 | 10/1996 | |
| JP | H11-225838 | 8/1999 | |
| JP | 2001-262875 | 9/2001 | |
| JP | 2008012119 A * | 1/2008 | ..... D06F 58/22 |
| JP | 2011-190810 | 9/2011 | |
| KR | 10-0587342 | 5/2006 | |
| KR | 10-2009-0024012 | 3/2009 | |
| KR | 10-2014-0087554 | 7/2014 | |

OTHER PUBLICATIONS

Chinese Office Action in Chinese Application No. 201610086717.1, dated Jul. 31, 2017, 13 pages (with English translation).

* cited by examiner

*Primary Examiner* — Jessica Yuen
(74) *Attorney, Agent, or Firm* — Fish & Richardson P.C.

(57) ABSTRACT

A laundry treatment apparatus may include a cabinet defining an appearance of the laundry treatment apparatus, a drum provided in the cabinet and configured to hold laundry, a connecting duct configured to communicate with the drum, a lint filter unit that is mounted to an inner surface of the cabinet that is accessible from a front surface of the cabinet, and that is configured to communicate with the connecting duct to filter pollutant and a lock unit configured to selectively lock the lint filter unit to the connecting duct, where the lock unit includes a rotatable lock body, a shaft configured to rotate together with the lock body, at least one bent portion, and a lock guide with at least one bent section.

3 Claims, 20 Drawing Sheets

LAUNDRY TREATMENT APPARATUS

This application claims the benefit of Korean Patent Application No. 10-2015-0023094, Feb. 16, 2015, No. 10-2015-0023103, Feb. 16, 2015, and No. 10-2015-0028900, Mar. 2, 2015, which is hereby incorporated by reference as if fully set forth herein.

BACKGROUND

A laundry treatment apparatus is an electrical household appliances which may include a washing machine, a drying machine, and a combined washing and drying machine for performing both laundry washing and drying operations.

In a laundry drying machine or a combined washing and drying machine, the air discharged from a drum during a drying operation may contain pollutants generated from the laundry. When such pollutants accumulate on the internal components of a laundry treatment apparatus, the laundry treatment apparatus may malfunction.

SUMMARY

According to one aspect, a laundry treatment apparatus may include a cabinet defining an appearance of the laundry treatment apparatus, a drum provided in the cabinet and configured to hold laundry, a connecting duct configured to communicate with the drum, a lint filter unit that is mounted to an inner surface of the cabinet, that is accessible from a front surface of the cabinet, and that is configured to communicate with the connecting duct to filter pollutants, and a lock unit configured to selectively lock the lint filter unit to the connecting duct, where the lock unit includes a rotatable lock body, a shaft configured to rotate together with the lock body, at least one bent portion, and a lock guide with at least one bent section.

Implementations according to this aspect may include one or more of the following features. For example, the lock unit may be configured to allow the lock guide to be inserted into the connecting duct and a portion of the lock guide to be in surface contact with an inner surface of the connecting duct to restrict the lint filter unit from being withdrawn from the front surface of the cabinet based on the lint filter unit being locked. The lock guide may include a first body, that has a guide hole, through which the a shaft extends, and that is configured to extend parallel to a front portion of the lint filter unit, and a second body that has a bent section, and that is configured to protrude from the first body toward the front portion of the lint filter unit. The second body may include a first bent section configured to protrude toward the front portion of the lint filter unit, and a second bent section, configured to extend from the first bent section in a same direction as the direction the first body of the lint filter unit is configured to extend. The lint filter unit may include a discharge duct and a filter which is configured to communicate with the connecting duct to filter pollutants, and where the discharge duct is configured to be withdrawable from the front surface of the cabinet, where the cabinet includes a rear cover with an air discharge hole configured to discharge air in the discharge duct to an outside of the apparatus, and a lower cover configured to prevent interference between an end of the discharge duct and the air discharge hole, and configured to include at least one guide for guiding motion of the discharge duct. The lint filter unit may include a filter housing including a holder, and the discharge duct includes a holder guide, where the holder includes a first holder body that has at least one through hole, and that is configured to couple with the filter housing, a second holder body configured to extend from the first holder body in a same direction as the direction the lint filter unit is withdrawn, and a third holder body that includes a plurality of bent portions, and that is configured to extend in the a longitudinal direction of the lint filter unit.

The plurality of bent portions may include a first bent section which is configured to be bent toward an outside of the lint filter unit, and a second bent section, which is configured to be bent toward an inside of the lint filter unit. The holder guide may include a fixing portion that has at least one through hole, and that is configured to couple the holder guide to the discharge duct, and a convex portion, which configured to be is bent toward an inside of the discharge duct. The lint filter unit may include a discharge duct, which is mounted in the cabinet and configured to be withdrawable from the front surface of the cabinet, and which includes a filter configured to communicate with the connecting duct to filter pollutants. The laundry treatment may include a blower which configured to communicate with the discharge duct to discharge air in the discharge duct to an outside of the apparatus, where the blower includes an upper body having that has a center hole and that is configured to define an upper face of the blower, a lower body configured to define a lower face of the blower, and a blade, configured to be rotatable with the upper body and the lower body, and including first ends coupled to the upper body and second ends coupled to the lower body, where the blade includes a body with a longitudinal length which is greater than a transverse length in a longitudinal cross-section of the body, and where the body includes a first bent body, which is bent along a longitudinal direction of the body. The first bent body may be disposed at a radial and inward portion of the body. The blade may include a second bent body, which is disposed at a radial and outward portion of the body. The first bent body may be configured to have a shape that corresponds to a shape of a second bent body. A first bend angle between the first bent body and the body may be the same as a second bend angle between the second bent body and the body.

The cabinet may include a first cabinet and a second cabinet including an upper panel disposed under the first cabinet, where the apparatus may include a first control device configured to be rotatably provided at a lower surface of the first cabinet to control a height of the first cabinet by adjustment of a rotational angle of the first control device, a through hole defined in the upper panel, a laundry container disposed in the second cabinet and configured to contain hold laundry, and a support member received in the through hole and configured to support the first control device. The support member may include a base positioned lower than the upper panel and configured to support the first control device. The support member may include a base positioned lower than the upper panel, and the first control device is mounted to the base, and at least two frames, which are bent from an outer circumference of the base toward the upper panel sand configured to couple the base to the upper panel. The at least two frames may include a first frame and a second frame, configured to be spaced apart from each other along the outer circumference of the base by a predetermined distance. The upper panel may include a first surface and a second surface positioned lower than the first surface, where the at least two frames include a first frame for configured to couple the base to the first surface, a second frame configured to couple the base to the second surface, and a third frame, which is positioned between the first frame and the second frame and configured to couple the base to the first surface. The first frame, the second frame, and the third frame may be configured to be spaced apart from each other along the outer circumference of the base by a predetermined distance.

DETAILED DESCRIPTION

Figure 1:
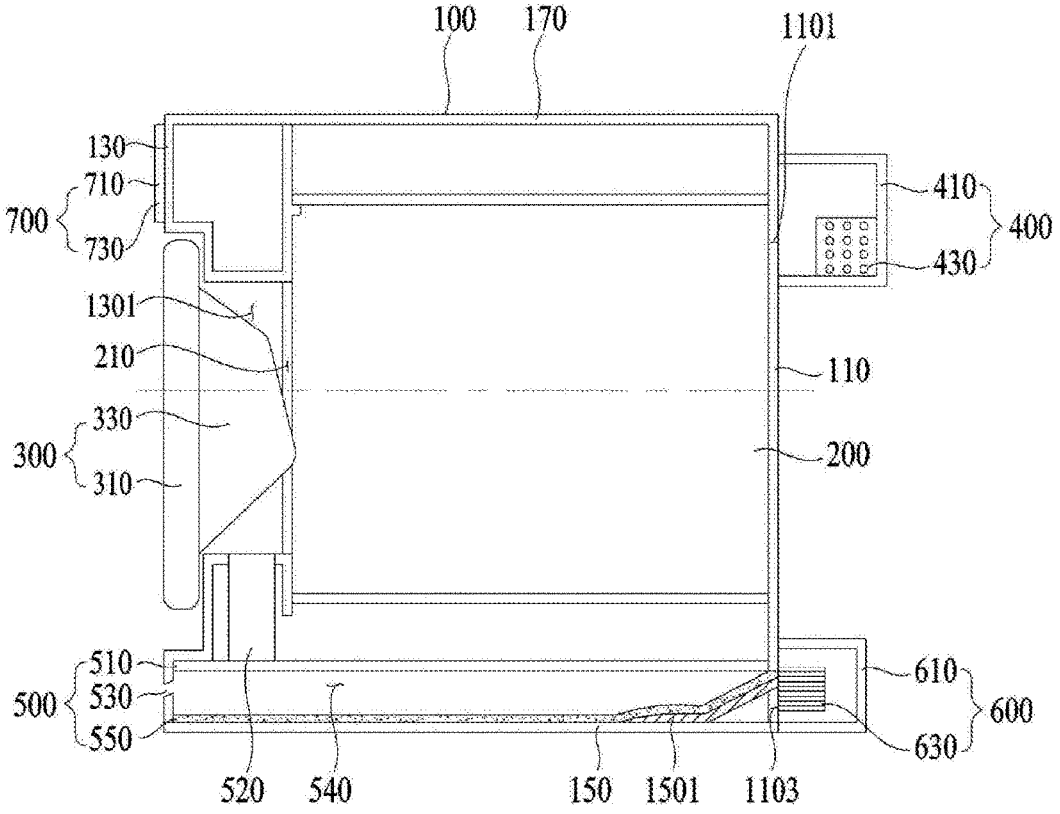
FIG. 1 is a side cross-sectional view of an example of a laundry treatment apparatus.

Referring to FIG. 1, the laundry treatment apparatus may include a cabinet 100 defining the appearance of the apparatus, a drum 200, which is disposed in the cabinet 100 to contain laundry, a door unit 300, which is disposed on the front face of the cabinet 100 and configured to open or close the cabinet 100 and the drum 200, thereby allowing the introduction of laundry, a heater unit 400, which is disposed on the rear face of the cabinet 100 to supply heated air to the inside of the laundry treatment apparatus, a blower unit 600, which is disposed on the rear face of the cabinet 100 to create a pressure gradient, thereby discharging the air in the laundry treatment apparatus to the outside of the apparatus, a lint filter unit 500, which is drawably disposed at the lower portion of the cabinet 100 to filter pollutants generated from laundry, and a control panel 700, which is disposed on the front face of the cabinet 100 to receive input associated with operation of the laundry treatment apparatus and to display the state of the laundry treatment apparatus.

As illustrated in FIG. 1, the cabinet 100 may include a front cover 130 defining the front face of the laundry treatment apparatus, a rear cover 110 defining the rear face of the laundry treatment apparatus, a lower cover 150 defining the bottom face of the laundry treatment apparatus, and an upper cover 170 defining the upper face of the laundry treatment apparatus.

The rear cover 110 may include an air introduction hole 1101 which allows external air to be introduced from the outside of the laundry treatment apparatus therethrough, and an air discharge hole 1103 which allows the air in the laundry treatment apparatus to be discharged to the outside.

Referring to the drawing, the air introduction hole 1101 may be located at an upper portion of the rear cover 110, and the air discharge hole 1103 may be located at a lower portion of the rear cover 110.

The air introduction hole 1101 has to communicate with the heater unit 400 because the air to be introduced through the air introduction hole 1101 has to be heated by the heater unit 400, and the air discharge hole 1103 has to communicate with the blower unit 600 because the air in the apparatus has to be discharged to the outside of the laundry treatment apparatus by the pressure gradient created by the blower unit 600.

The heater unit 400 may include a heater housing 410, which protrudes from one side of the rear cover 110 to provide an accommodation space, and a heater 430, which is disposed in the heater housing 410 to heat the air inside the heater housing 410.

The heater housing 410 may include at least one through hole, through which air outside the laundry treatment apparatus can be introduced.

The blower unit 600 may include a blower housing 610, which protrudes from one side of the rear cover 110 to provide an accommodation space, and a blower 630, which is disposed in the blower housing 610 to create a pressure gradient for causing the air inside the laundry treatment apparatus to be discharged to the outside of the laundry treatment apparatus.

Similarly to the heater housing 410, the blower housing 610 may also include at least one through hole to allow the air in the blower housing 610 to be discharged to the outside of the laundry treatment apparatus.

The front cover 130 may include a front cover hole 1301, which provides a space for allowing laundry to be taken out of the drum, and the drum 200 may also include an opening 210 which is configured to communicate with the front cover hole 1301 formed in the front cover 130.

Accordingly, the door unit 300 may be disposed at a location corresponding to the front cover hole 1301 and the opening 210 such that a user can open or close the front cover hole 1301 and the opening 210 when necessary. The door unit 300 may include a door 310 defining the front part of the door unit 300 and a bulging portion 330 protruding from the rear surface of the door 310.

The door 310 and the bulging portion 330 may be made of a transparent material to enable a user to view the inside of the laundry treatment apparatus while in operation.

The control panel may include an input device 710 through which input required for operation of the laundry treatment apparatus may be received from a user, and a display 730 for displaying the current operational state of the laundry treatment apparatus to a user.

Figure 2:
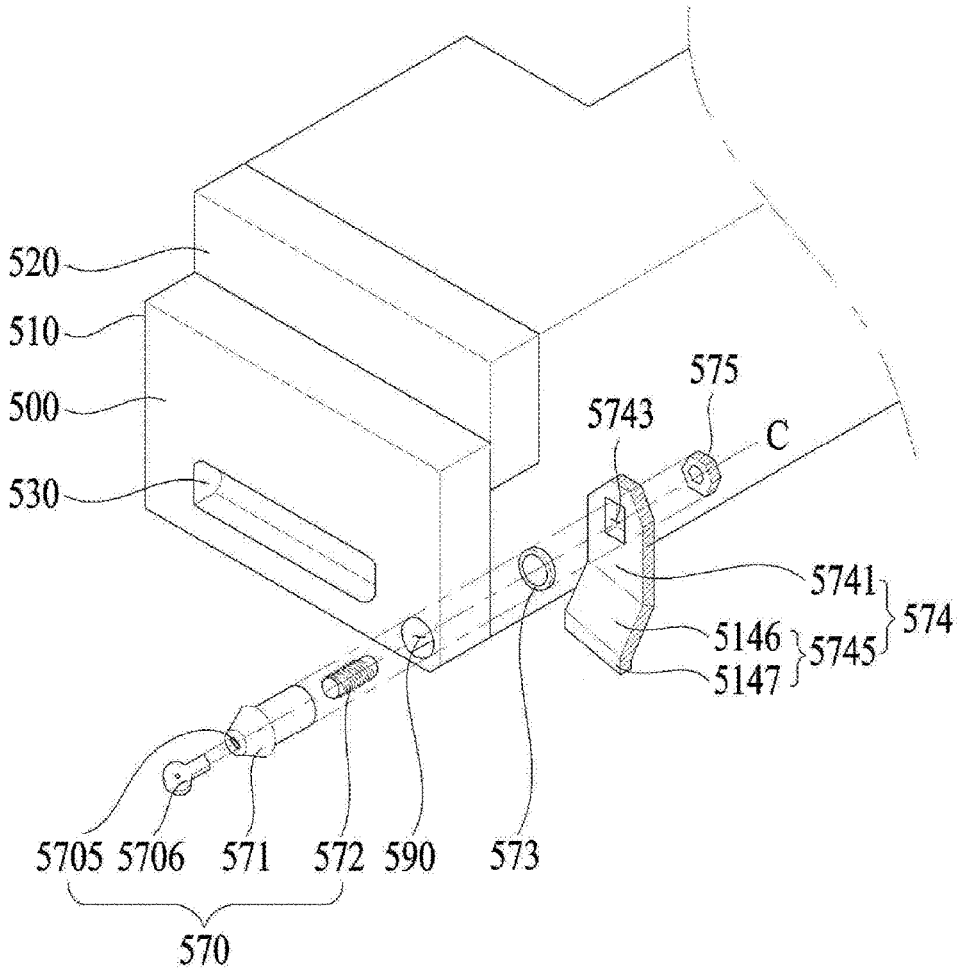
FIG. 2 is an exploded view showing an example of a lock unit of a lint filter unit.

Referring to FIG. 2, the lint filter unit 500 may include a filter housing 510, which defines the appearance of the lint filter unit 500 and is drawably disposed, a discharge duct 540 (see FIG. 4), which is disposed on the lower surface of the cabinet 100 to provide a space for guiding the air inside the laundry treatment apparatus to the outside and to define the accommodation space in the filter housing 510, a handle 530, which is recessed into the front portion of the filter housing 510 and configured to be gripped by a user, a filter 550, which is disposed in the longitudinal direction of the discharge duct 540 to filter the air inside the laundry treatment apparatus, and the lock unit 570 and a lock hole 50, which are provided so as to protect the lint filter unit 500 against theft after the lint filter unit 500 is fitted into the discharge duct 540.

The discharge duct 540 may communicate with a connecting duct 520, which is connected to the lower end of the drum 200 to guide the air inside the drum 200.

External air outside the laundry treatment apparatus may be introduced into the heater housing 410 of the heater unit 400. The air, which has been introduced from the outside, is heated by the heater 430 disposed in the heater housing 410. The heated air flows into the drum 200 through the air introduction hole 1101 formed in the rear cover 110. The heated air is supplied to laundry contained in the drum 200 and undergoes heat exchange. Subsequently, the air flows into the discharge duct 540 through the connecting duct 520, which communicates with the lower end of the drum 200. The air, which has been introduced into the discharge duct 540, flows into the blower unit 600 through the air discharge hole 1103 formed in the rear cover 110.

The air is discharged to the outside of the laundry treatment apparatus through the blower housing 610 due to the pressure gradient created by the blower 630 provided in the blower unit 600.

In some examples, the lock hole 590 may be provided at any location in addition to the front portion of the filter housing 510, as long as the filter housing 510 can be fastened to the discharge duct 540.

The lock unit 570 may include a lock body 571, which is configured to be fitted into the lock hole 590, a shaft 527, which is rotatably connected to the lock body 571, a lock guide 574 having a hole through which the shaft 572 is inserted to secure the lint filter unit 500 to the connecting duct 520, a rivet 573, which is disposed in front of the lock guide 571 and has a hole therein, and a nut 575, which is disposed behind the lock guide 571 and has a hole therein for holding the shaft 572.

The lock body 571 may include a key hole 5705 formed in the front portion of the lock body 571 and a key 5706, which is fitted into the key hole 5705 to rotate the lock body 571

The lock guide 574 may include a first body 5741, which has a guide hole 5743, into which the shaft 572 is inserted, and has a vertical length longer than a horizontal length, and a second body 5745 extending from the first body 5741.

The second body 5745 may include a first bent section 5746, which is bent forward from the first body 5741, and a second bent section 5747, which is bent from the first bent section 5746 and extends in the longitudinal direction of the first body 5741.

The principle whereby the lint filter unit 500 is locked by the lock unit 570 will be described briefly below based on the above-described construction.

After the filter housing 510 is coupled to the discharge duct 540 (see FIG. 1) by a user, the key 5706 may be inserted into the key hole 5705, formed in the front portion of the lock body 571, and may be rotated clockwise.

When the lock body 571 is rotated, the shaft, which is integrally coupled to the lock body 571, is rotated. As the shaft 572 is rotated, the lock guide 574, which is rotatable together with the shaft 572, is rotated, whereby a portion of the lock guide 574 is engaged with the inner surface of the connecting duct 520. Consequently, the lint filter unit 500 is fastened to the connecting duct 520.

Figure 3A:
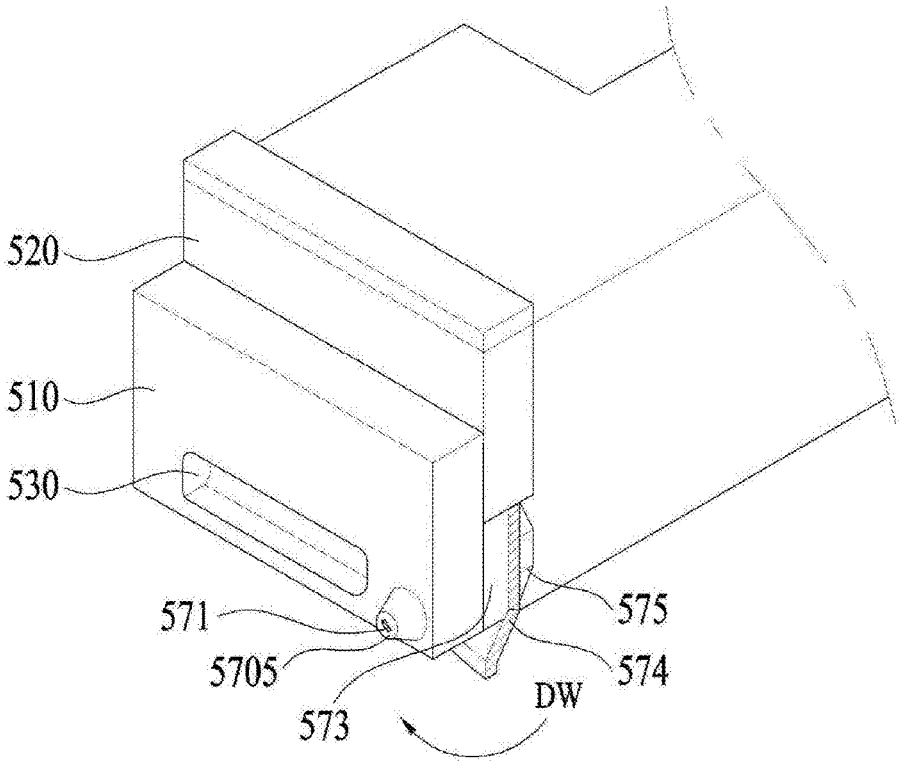
FIGS. 3A and 3B are views showing an example of the coupled state between the lint filter unit and a connecting duct.

Referring to FIG. 3A, when the lock of the lint filter unit 500 is released, the lock guide 574 is positioned such that it extends toward the lower cover 150, whereby the lock guide 574 does not constrain the lint filter unit 500 and the connecting duct 520.

The key 5706 may be inserted into the key hole 5705 and may be rotated in the clockwise direction DW by a user, whereby the lock of the lint filter unit 500 is engaged.

As described above, since the lock body 571 and the lock guide 574 are fastened to each other so as to be rotated together by the shaft 572, the lock body 571 and the lock guide 574 are rotated clockwise by rotation of the key 5706 in the clockwise direction DW by a user.

Figure 3B:
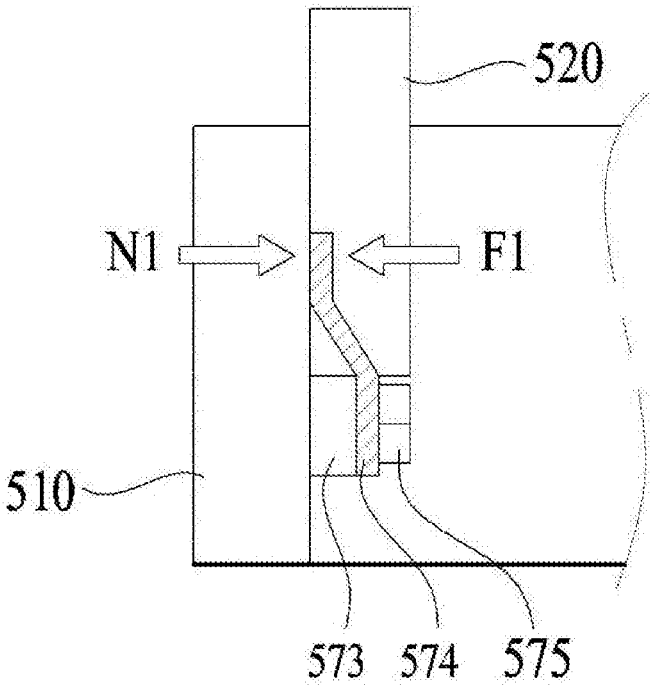

Referring to FIG. 3B, by a user's locking action, the lock guide 574 is rotated 180°, thereby constraining the lint filter unit 500 and the connecting duct 520.

Although this example is illustrated as engaging the lock of the lint filter unit 500 by rotation of the lock guide 574 by 180°, the rotating angle of the lock guide 574 may be varied in accordance with the shape of the lock guide 574, and is not limited to 180° as in this example.

Unlike the shape of the lock guide 574, a conventional lock guide 574 is constituted only by the first body 5741, without the second body 5745 including the bent sections.

Accordingly, when the lock of the lint filter unit 500 is implemented by such a conventional lock guide 574, a gap occurs between the lint filter unit 500 and the lock guide 574. Consequently, when the lint filter unit 500 is repeatedly pushed into and taken out of the discharge duct 540 by a user gripping the handle 530 of the lint filter unit 500, the lock guide 574 becomes deformed, and the lock of the lint filter unit 500 is released, thereby raising the concern of theft.

In contrast, the lock guide 574 may include the first body 5741 and the second bent section 5747, which is bent from the first body 5741, and the second bent section 5747 protrudes from the first body 5741 by a predetermined distance and comes into surface contact with the lint filter unit 500.

Accordingly, when the lint filter unit 500 is repeatedly pushed into and taken out of the discharge duct 540 by a user gripping the handle 530 of the lint filter unit 500, the second bent section 5747 applies elastic force F1 to the lint filter unit 500, and the lint filter unit 500 applies a counteracting force N1, which is generated against the elastic force F1 so as to realize force equilibrium between the elastic force F1 and the counteracting force N1. This is different from a conventional lint filter unit 500.

Since the elastic force F1 and the counteracting force N1 are in a force equilibrium state, relative motion of the lint filter unit 500 does not occur, thereby preventing release of the lock of the lint filter unit 500 due to the deformation of the lock guide 574.

Figure 4:
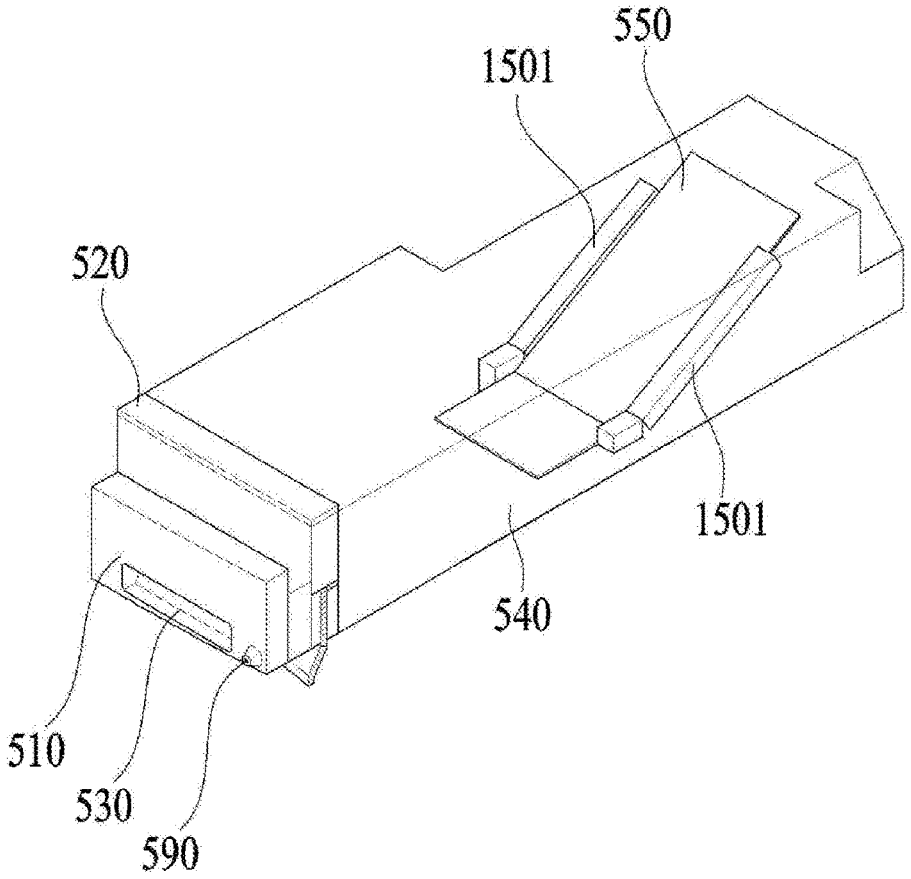
FIG. 4 is a perspective view showing an example of the lint filter unit coupled to the connecting duct.

Referring to FIG. 4, the lint filter unit 500 is connected to the connecting duct 520, which guides the air inside the drum 200 into the filter housing 510.

The lint filter unit 500 may include a filter guide 1501, which is disposed on the lower surface of the discharge duct 540 so as to guide a portion of the filter 550.

As described above, a conventional laundry treatment apparatus is configured to filter air, introduced into the drum 200, by mounting the filter 550 on the connecting duct 520. In contrast, the laundry treatment apparatus may include the filter 550, which is extended in the longitudinal direction of the drum 200 so as to increase the capacity of the filter.

In this implementation, the filter guide 1501 is illustrated as being inclined at a predetermined angle with respect to the lower surface of the discharge duct 540.

Specifically, the filter guide 1501 is inclined at a predetermined angle with respect to the lower surface of the discharge duct 540, thereby preventing the filter 550 from drooping due to gravity.

Figure 5:
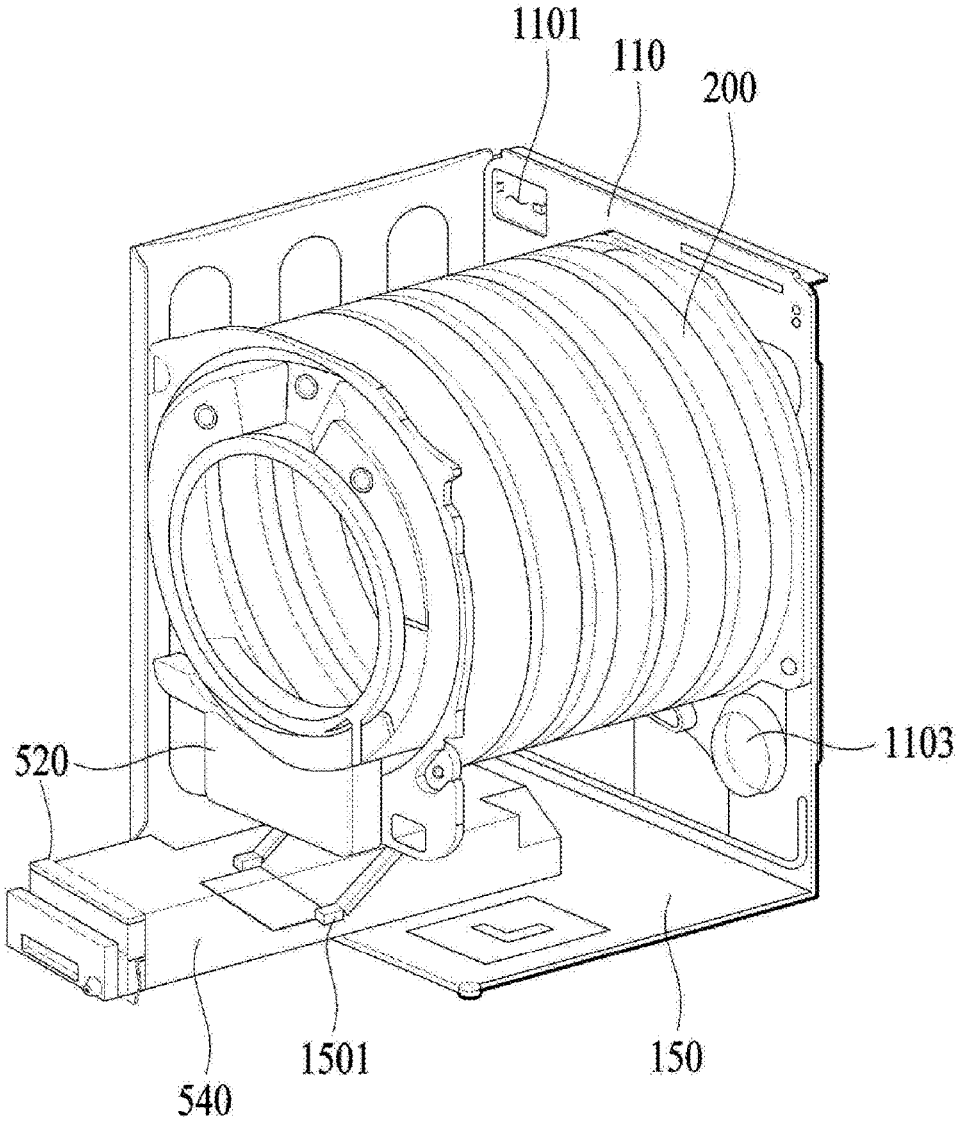
FIG. 5 is a perspective view showing an example of a cabinet and the lint filter unit, which are coupled to each other.

Referring to FIG. 5, the lint filter unit 500 may be configured to be fitted into the lower surface of the drum 200.

The cabinet 100 is first assembled, and the drum 200 is mounted in the cabinet 100 by a user. After the mounting of the drum 200, the lint filter unit 500 is fitted into the lower surface of the drum 200.

Here, the rear portion of the lint filter unit 500 has to be assembled so as to communicate with the air discharge hole 1103 formed in the rear cover 110.

However, when the lint filter unit 500 is fitted after the drum 200 is first installed as described above, the air discharge hole 1103 is invisible due to the drum 200 and the lint filter unit 500. Consequently, there is a problem whereby the lint filter unit 500 is damaged owing to interference between the lint filter unit 500 and the air discharge hole 1103 during the assembly operation by a user.

Figure 6:
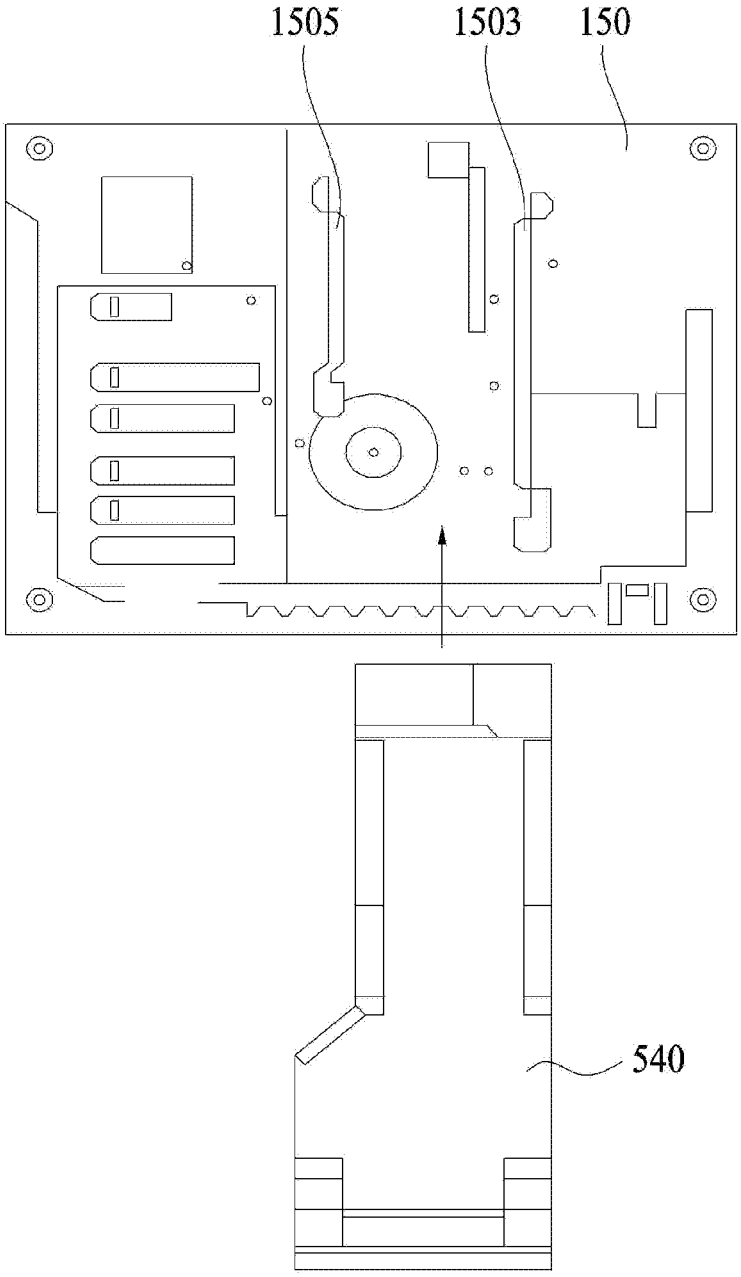
FIG. 6 is a plan view showing an example of a lower cover and the lint filter unit.

In order to solve this problem, the lower cover 150 may include a plurality of guides 1503 and 1505. Referring to FIG. 6, in order to solve the above-mentioned problem, the lower cover 150 of the laundry treatment apparatus may include the first guide 1503 and the second guide 1505.

More specifically, when a user views the front face of the cabinet 100, the first guide 1503 may protrude upward so as to guide the right portion of the lint filter unit 500.

The first guide 1503 serves to support the right portion of the lint filter unit 500 such that, when the lint filter unit 500 is fitted, the lint filter unit 500 moves toward the air discharge hole 1103 so as to communicate with the air discharge hole 1103.

In some implementations, the first guide 1503 may be variously configured as long as the first guide 1503 serves to prevent the lint filter unit 500 from deviating rightward from the path that communicates with the air discharge hole 1103.

The second guide 1505 serves to support the left portion of the lint filter unit 500 such that, when the lint filter unit 500 is fitted, the lint filter unit 500 moves toward the air discharge hole 1103 so as to communicate with the air discharge hole 1103.

I some implementations, the second guide 1505 may be variously configured, as long as the second guide 1505 serves to prevent the lint filter unit 500 from deviating leftward from the path connected to the air discharge hole 1103.

Figure 7A:
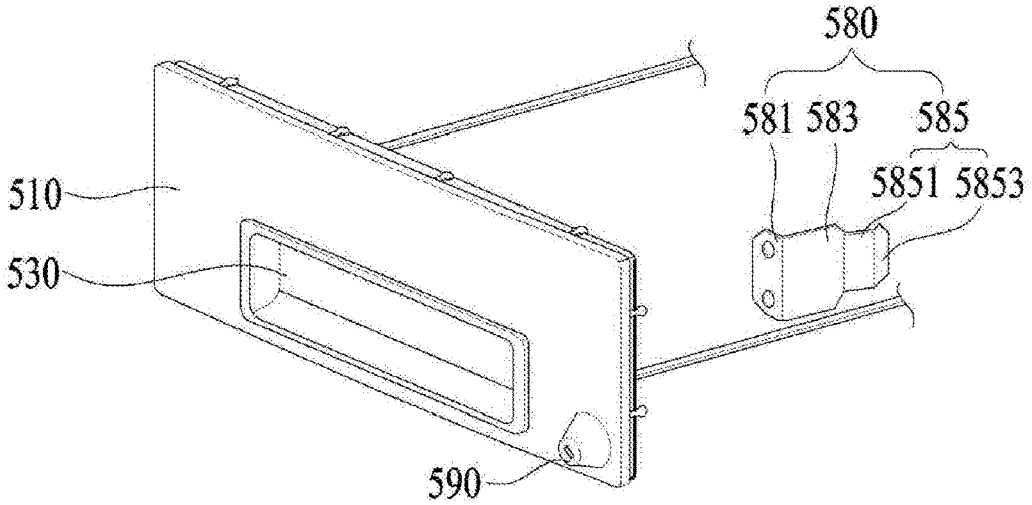
FIGS. 7A and 7B are perspective views showing an example of a discharge duct and the lint filter unit.

Referring to FIG. 7A, the laundry treatment apparatus may further include a holder 580 connected to one side of the lint filter unit 500, that is, one side of the filter housing 510.

The drawing illustrates an example in which the holder 580 is mounted on the right region of the lint filter unit 500. However, the holder 580 is not limited to this arrangement, and may be mounted on any region of the lint filter unit 500 as long as the holder 580 contacts a holder guide 541, which will be described below.

The holder 580 may include a first holder body 581, which is bent to allow the holder 580 to be coupled to the front portion of the lint filter unit 500, that is, the filter housing 510, a second holder body 583 extending from the first holder body 581 in the longitudinal direction of the lint filter unit 500, and a third holder body 585 including a plurality of bent portions, which extend in the longitudinal direction of the lint filter unit 500.

The first holder body 581 may include at least one hole, through which a fastening member extends so as to couple the first holder body 581 to the lint filter unit 500.

The third holder body 585 may include a first bent section 5851, which is bent outward, and a second bent section 5853, which is bent inward.

As will be described later, the first bent section 5851 and the second bent section 5853 may be constituted by an elastic member such that they are engaged with the holder guide 541 while the first and second bent section and the holder guide are subjected to opposing forces.

Figure 7B:
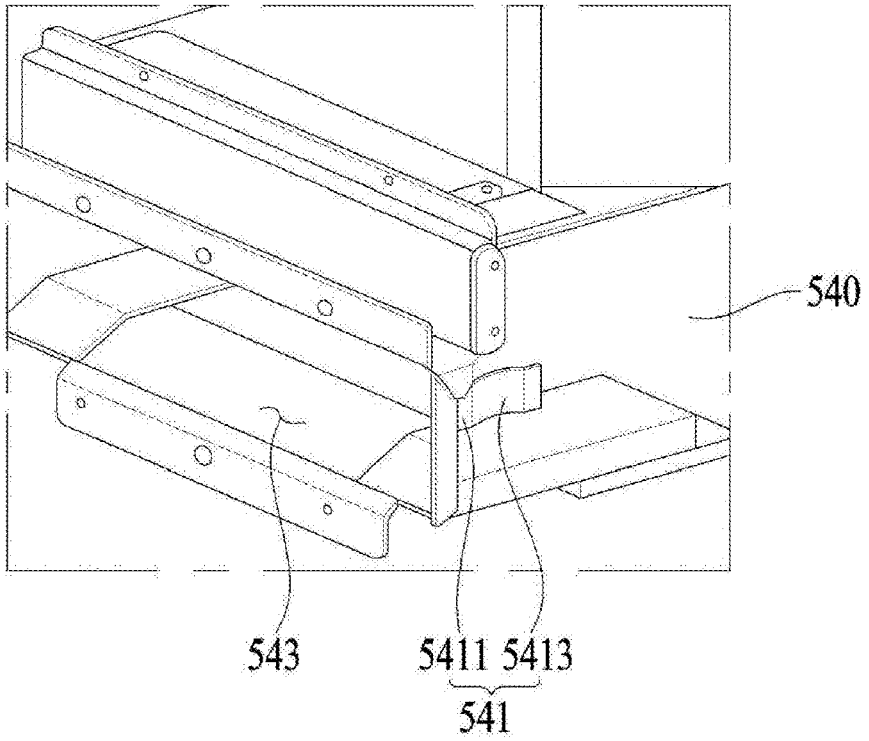

Referring to FIG. 7B, the discharge duct 540 may include a duct opening 543 through which the lint filter unit 500 is introduced into or drawn out of the discharge duct 540, and a holder guide 541, which is disposed on the inner surface of the discharge duct 540 so as to accommodate the holder 580 of the lint filter unit 500.

The holder guide 541 may include fixing portions 5411, which are configured to have an arch shape and are provided at opposite ends of the holder guide 541 so as to mount the holder guide 541 to one side of the discharge duct 540, and a convex portion 5413, which is located at the center of the holder guide 541 and is bent inward.

The holder guide 541 may be configured to have any shape as long as the holder guide 541 and the holder 580 are subjected to opposing forces, which are perpendicular to the direction in which the lint filter unit 500 is introduced into or drawn out of the discharge duct 540, in a mutual contact state.

Figure 8:
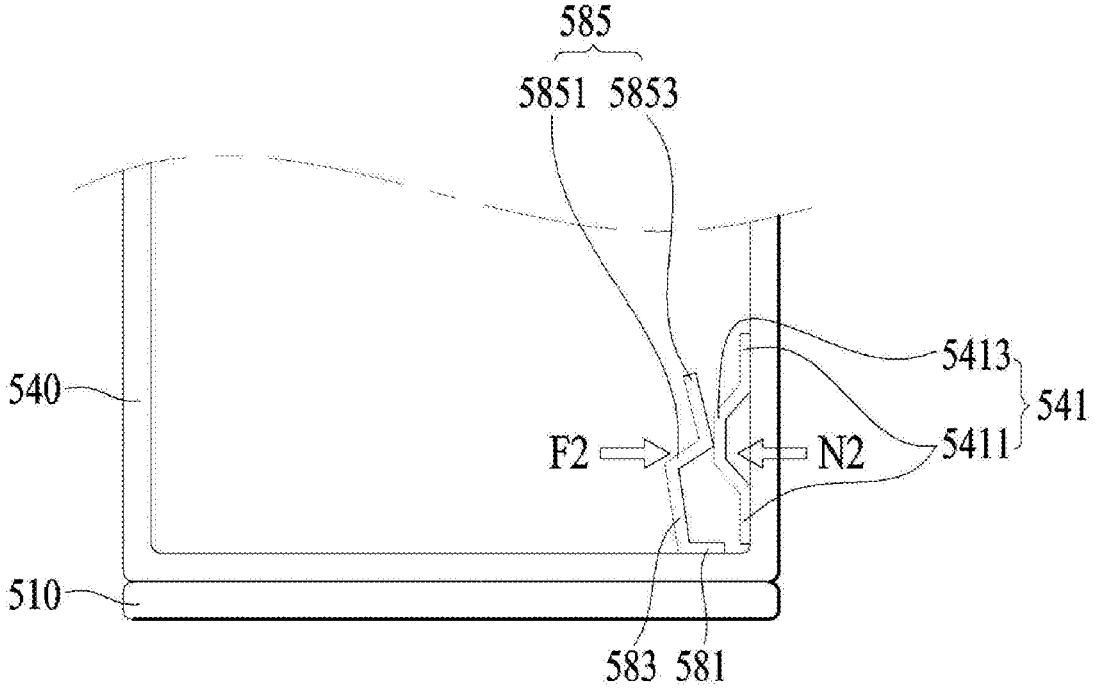
FIG. 8 is a view showing an example of the discharge duct and the lint filter unit, which are coupled to each other.

Referring to FIG. 8, when the filter housing 510 is fitted into the discharge duct 540, the holder 580 and the holder guide 541 may be in a force equilibrium state while being subjected to opposing forces. In some examples the holder 580 may be made of an elastic member.

When the lint filter unit 50 is fitted into the discharge duct 540, the third holder body 585, which is bent so as to protrude outward, may be engaged with the holder guide 541.

After the second bent section 5853, which is bent so as to protrude inward, comes into contact with the convex portion 5413 of the holder guide 541, the second bent section 5853 slides along the surface of the convex portion 5413 as the filter housing 510 is fitted.

When the filter housing 510 is completely fitted into the discharge duct 540, the holder 580 and the holder guide 541 achieve force equilibrium therebetween while being subjected to opposite forces, which are perpendicular to the direction in which the filter housing 510 is fitted, as shown in FIG. 8.

Accordingly, it is possible to prevent the filter housing 510 from being unintentionally drawn from the discharge duct 540 due to vibrations generated from the laundry treatment apparatus while the filter housing 510 is kept fitted in the discharge duct 540.

More specifically, the holder 580 applies a restoring force F2 to the holder guide 541, and the holder guide 541 applies the counteracting force N2 in the direction opposite to the direction of the restoring force F2, whereby the restoring force F2 and the counteracting force N2 are in a force equilibrium state.

Since the filter housing 510 is coupled with the discharge duct 540 while the restoring force F2 and the counteracting force N2 are in a force equilibrium state, it is possible to prevent the lint filter unit 500 from being unintentionally drawn from the discharge duct 540.

Figure 9:
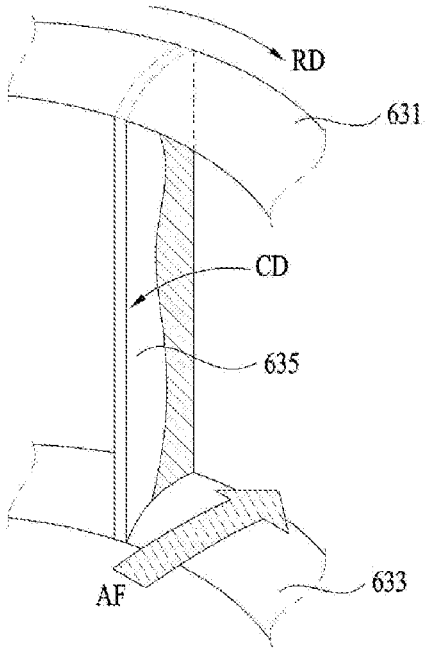
FIG. 9 is a perspective view showing an example of a conventional blower.

Referring to FIG. 9, the blower 630 may include an upper body 631, which defines the upper face of the blower 630 and has a center hole therein, a lower body defining the lower face of the blower 630, and blades 635, which include first ends connected to the upper body 631 and second ends connected to the lower body 633, so as to cause air to flow.

The blade 635 of the conventional blower has a curved cross-section, as illustrated. When the blower 630 rotates in the direction RD, air is introduced through the center hole in the upper body 631, and is discharged in the radial and outward direction AF through a gap between the blades 635.

Although the air introduced into the blower 630 has passed through the filter 550 provided in the lint filter unit 500, the air may contain fine pollutants because not all of the pollutants are filtered by the filter 550.

Accordingly, the conventional blower is problematic in that such fine pollutants accumulate on the blades 635 while being discharged in the outward direction AF in the radial direction.

More specifically, the pollutants accumulate on the areas of the blades 635 that are located in the direction opposite to the outward direction AF in the radial direction.

Since burrs are formed on one side of the blade 635, pollutants contained in the air that is discharged to the outside adhere to the burrs. As air is continually discharged, pollutants adhered to the burrs agglomerate, and the agglomerate grows in the direction CD, opposite to the outward direction AF in the radial direction.

Figure 10:
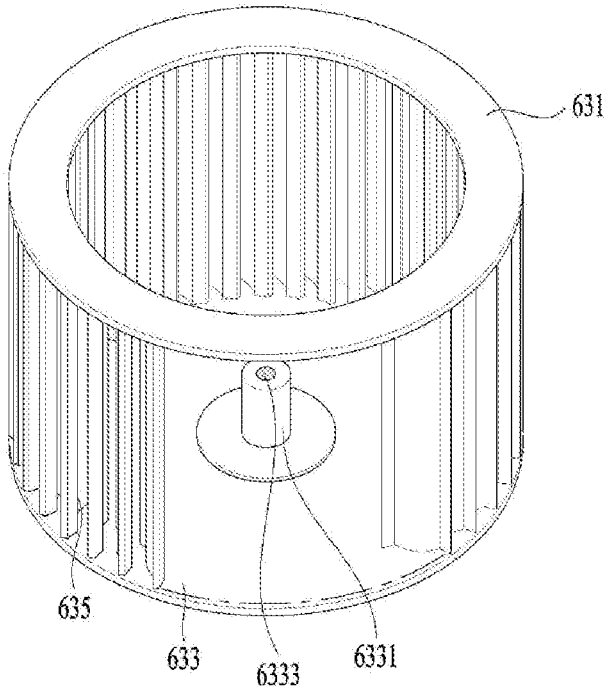
FIG. 10 is a perspective view showing an example of a blower of the laundry treatment apparatus.

FIG. 10 is a perspective view showing the blower of the laundry treatment apparatus.

Referring to FIG. 10, the blower 630 may include an upper body 631, which defines the upper face of the blower 630 and has a center hole therein, a lower body 633 defining the lower face of the blower 630, and at least one blade 635, which has one hand connected to the upper body 631 and the other end connected to the lower body 633.

Each of the upper body 631 and the lower body 633 has at least one through hole such that the through hole in the upper body 631 is positioned to correspond to the through hole in the lower body 633. The opposite ends of each of the blades 635 may be fitted into the through holes.

The lower body 633 may be constituted by a circular plate, and may include a protrusion 6331 protruding upward from the center thereof. The protrusion 6331 may include a through hole 6333 through which a shaft for transmitting rotational force to the blower 630 extends.

As shown in FIG. 10, the blade 635 may be configured to have a plate shape having a longitudinal length greater than a transverse length in a longitudinal cross-section. The blade 635 has bendable portions at opposite ends thereof such that the bendable portions of the blade 635 extend through through holes formed in the upper body 631 and the lower body 633 and are bent, whereby the blade 635 may be secured to the upper and lower bodies 631 and 635.

In some implementations, the blade 635 may be coupled by any way of coupling the blade to the upper and lower bodies 631 and 635.

Figure 11A:
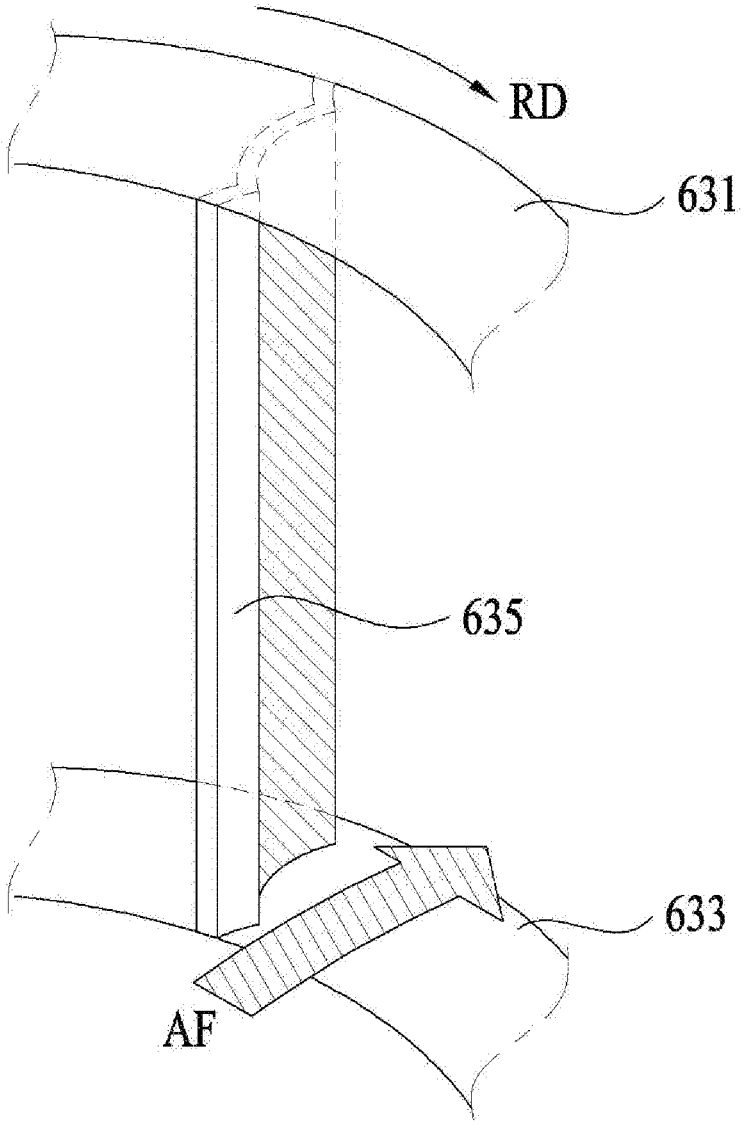
FIGS. 11A and 11B are views showing an example of the blower and the blades of the laundry treatment apparatus.

Referring to FIG. 11A, the blade 635 is characterized by having at least one inflection point in a transverse cross-section.

More specifically, the blade 635 may include a body 6351, which is positioned at the center of the blade 635 and has an arch shape, a first bent body 6353 disposed at one end of the body 6351, and a second bent body 6355 disposed at the other end of the body 6351.

The first bent body 6353 and the second bent body 6355 may be bent at the two ends of the arch-shaped body 6351 in opposite directions in a rotational direction.

As shown in FIG. 11A, the blower 630 may rotate in the clockwise direction RD. As the blower 630 rotates, the air, which has been introduced into the upper body 631, is discharged from the center of the blower 630 outward in the outward direction AF in the radial direction. Unlike the conventional blade 635 shown in FIG. 9, since the blade 635 is provided with the second bent body 6355 at the end thereof that is located outward in the radial direction, there is an effect in that pollutants contained in air do not accumulate thereon and are discharged with the air.

In other words, the first bent body 6353 may be disposed at the innermost location of an introduction end, through which air is introduced, and the second bent body 6355 may be disposed at the outermost location of a discharge end, through which air is discharged.

Specifically, what prevents pollutants from accumulating on the blade 635 is the second bent body 6355 rather than the first bent body 6353, which is disposed at the radial and inward end.

Figure 11B:
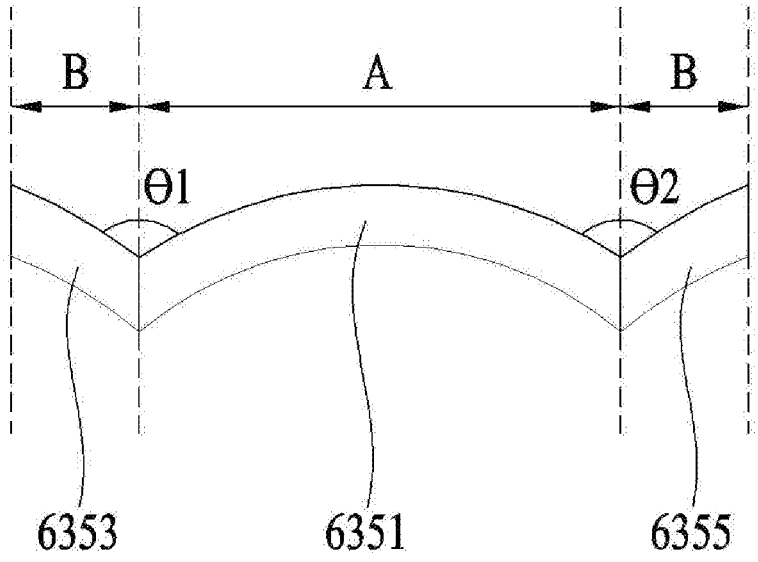

However, since the blade 635 is also provided at the radial and inward end thereof with the first bent body 6353, the blade 635 may be symmetrically configured, as shown in FIG. 11B.

The radial length B of the first bent body 6353 may be the same as the radial length of the second bent body 6355, and the first bend angle θ1 between the first bent body 6353 and the body 6351 may be the same as the second bend angle θ2 between the second bent body 6355 and the body 6351.

The blower 630 is typically manufactured by separately producing individual components (for example, the upper body, the lower body, the blade and the like) and assembling the components in an assembly process by a worker.

Figure 12:
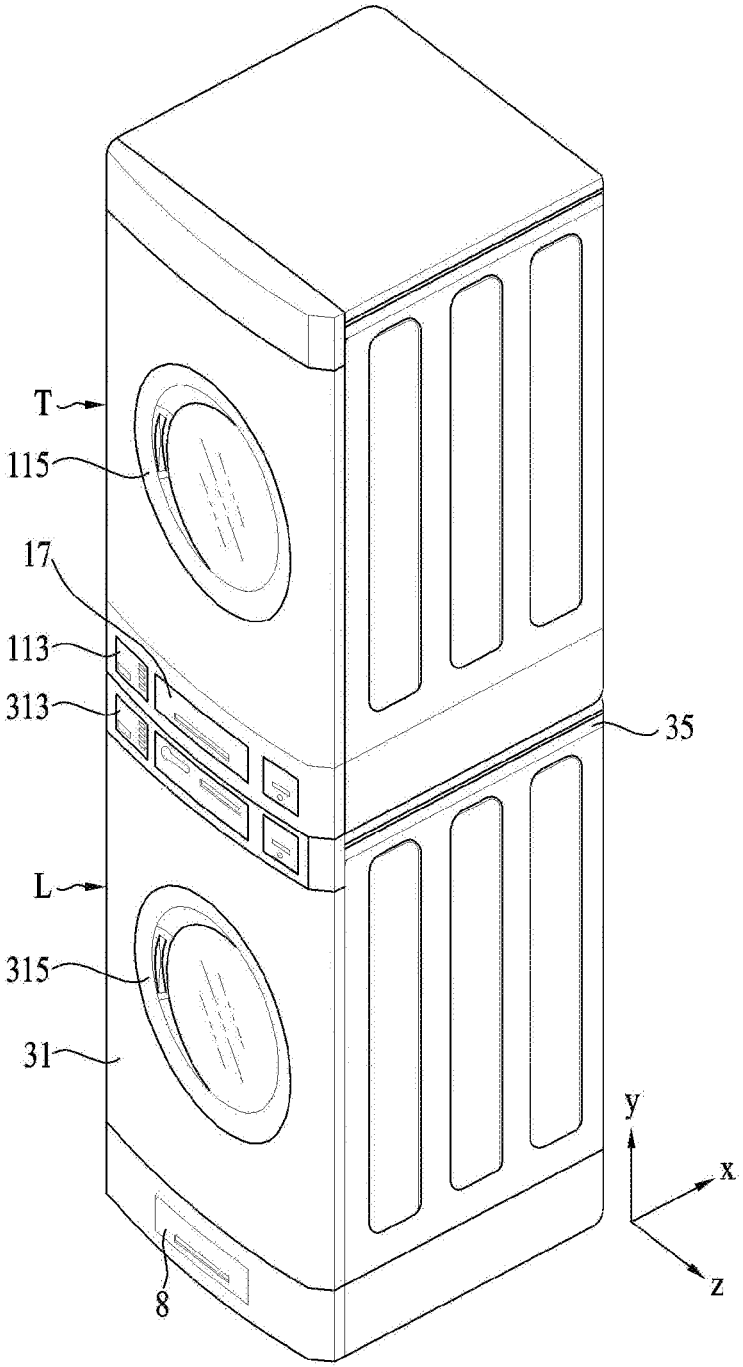
FIG. 12 is a perspective view showing an example of the laundry treatment apparatus.

As shown in FIG. 12, the laundry treatment apparatus may include a first treatment apparatus T, capable of performing a washing, drying or washing and drying operation, and a second treatment apparatus L, which is disposed under the first treatment apparatus T so as to support the first treatment apparatus T. The second treatment apparatus L may also perform a washing, drying or washing and drying operation.

Figure 13:
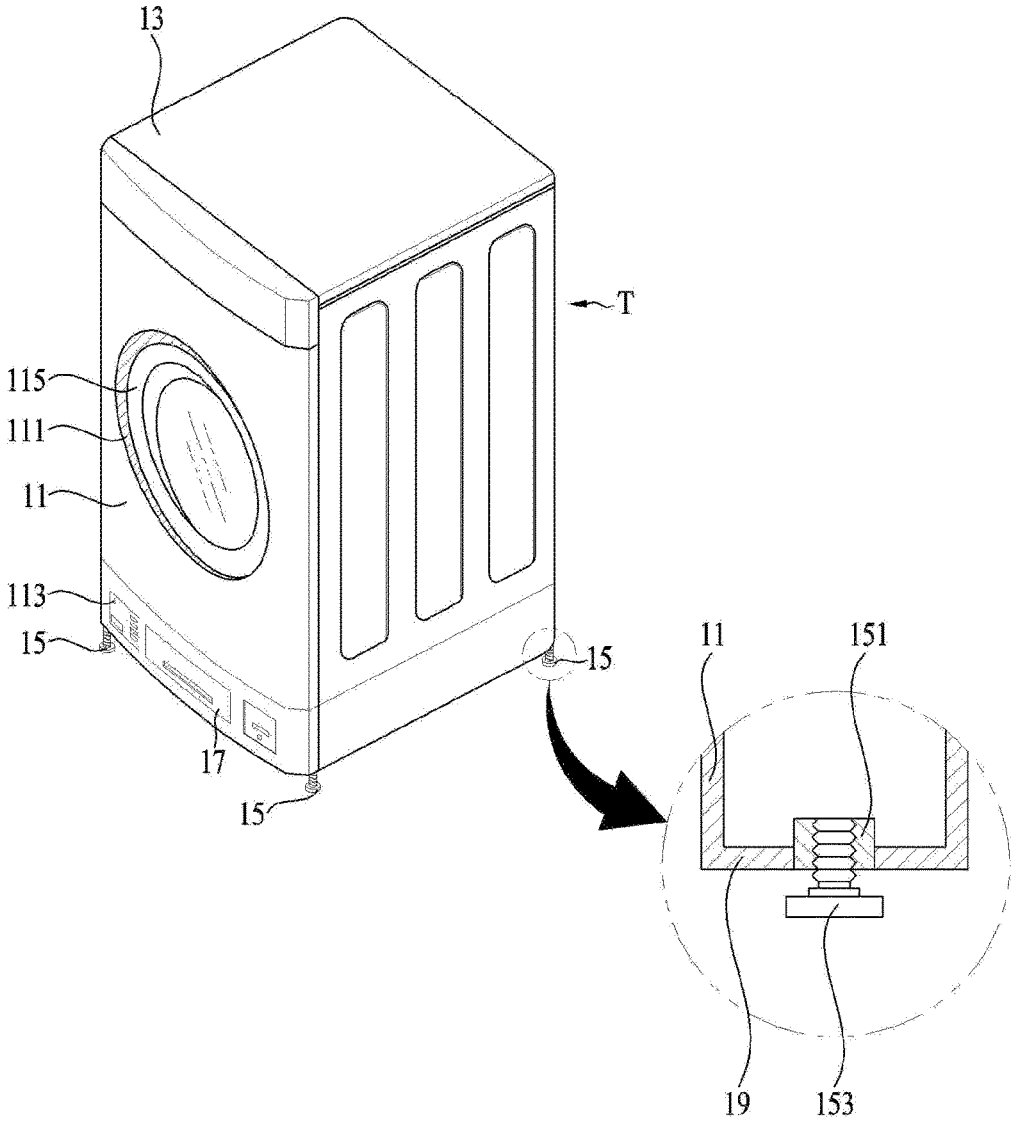
FIG. 13 is a perspective view showing an example of a first treatment apparatus.

As shown in FIG. 13, the first treatment apparatus T may include a first cabinet 1, defining the appearance of the first treatment apparatus T, and a first container, which is disposed in the first cabinet 1 so as to provide a space for accommodating laundry.

The first cabinet 1 includes a control panel 113, which is provided on the front face thereof so as to allow the input of control commands, a first introduction port 111 communicating with the first container, and a door 115 for opening or closing the first introduction port 111.

When the first treatment apparatus T serves as an apparatus for performing a laundry washing operation, the first container may include a first tub, which is disposed in the first cabinet 1 so as to contain water, and a first drum, which is rotatably disposed in the first tub.

In this case, the first cabinet 1 may further include therein a first drive unit for rotating the first drum in response to control commands input through the first control panel 113, a first water supply unit for supplying water to the first tub, and a first water discharge unit for discharging the water contained in the first tub.

When the first treatment apparatus T serves as an apparatus for drying laundry, the first container may be provided as a first drum, which is disposed in the cabinet 1 to contain laundry.

In this case, the first cabinet 1 should include a first drive unit for rotating the first drum, a first air supply unit for supplying hot air to the first drum, and a first air discharge unit for discharging the air in the first drum.

In addition, the first treatment apparatus T serves as an apparatus for performing both washing and drying operations, the first container may be provided as a first tub and a first drum, and the first cabinet 1 may include a first drive unit for rotating the first drum, a first water supply unit for supplying water to the first tub, a first water discharge unit for discharging the water, a first air supply unit for supplying hot air to the first tub, and a first air discharge unit for discharging the air inside the first tub and discharging the air to the outside of the first cabinet.

When the first treatment apparatus T serves to dry laundry, the first air discharge unit should include a first filter unit 17 for filtering air discharged from the first tub. It is preferable that the first filter unit 18 be detachably mounted on the front surface of the first cabinet 1.

In a conventional laundry treatment apparatus, in order to make it easy to separate the filter unit from the laundry treatment apparatus, the filter unit is provided at a connecting duct, which is disposed in the height direction of the first drum. However, since the length of the connecting duct cannot vary as long as the volume of the laundry treatment apparatus does not vary, it is difficult to increase the filtering capacity of the filter unit in such a conventional laundry treatment apparatus.

The first cabinet 1 may be provided at the bottom surface 19 thereof with first control devices 15 for controlling the height of the first cabinet 1 (horizontal control). The first control device 15 may include a fixing body 151 fixed to the bottom surface 19, and a control body 153, which is rotatably provided in the fixing body 151 to control the height of the first cabinet 1 by adjusting the rotational angle thereof.

The structures of the fixing body 151 and the control body 153 may be variously modified as long as they can fulfill the above-mentioned function. In an example, the fixing body 151 may be provided with an internal thread, and the control body 153 may be provided with an external thread which is threaded with the internal thread.

Figure 14:
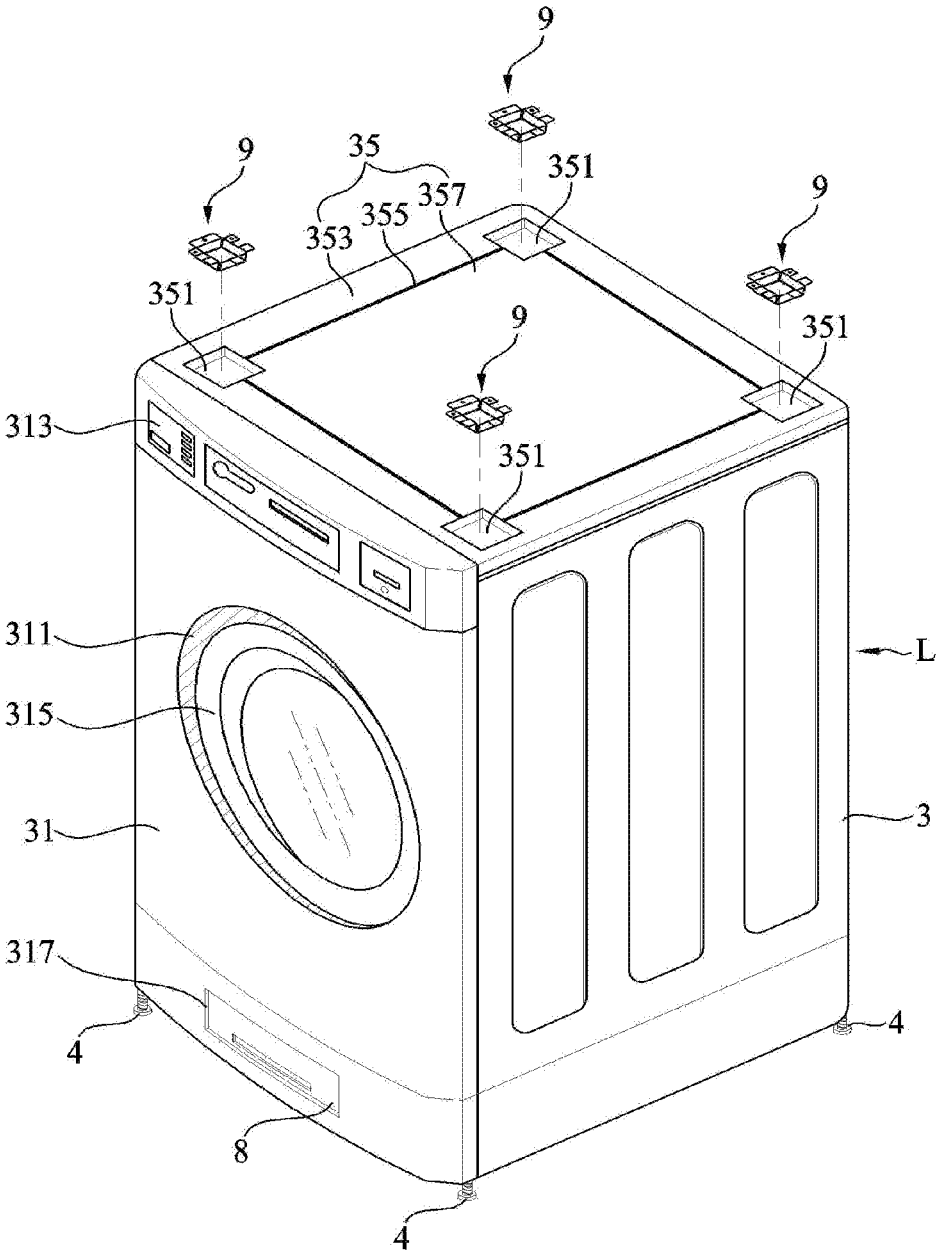
FIGS. 14 to 15B are views showing an example of a second treatment apparatus.

As shown in FIG. 14, the second treatment apparatus may include a second cabinet 3, which defines the appearance of the second treatment apparatus L and is disposed under the first cabinet 1, and a second container, which is disposed in the second cabinet 3 to provide a space for accommodating laundry.

The second cabinet 3 may include a front panel 31, defining the front face of the second treatment apparatus L, an upper panel 35, which defines the upper face of the second cabinet 3 and provides a space in which the first treatment apparatus T is mounted, and a rear panel 38, defining the rear face of the second treatment apparatus L.

The front panel 31 may include a second introduction port 311, communicating with the second container, a second door 315 for opening or closing the second introduction port 311, and a second control panel 313 which allows control commands to be input to the second treatment apparatus L therethrough.

The first treatment apparatus T differs from the second treatment apparatus L in that the first control panel 113 of the first treatment apparatus T is positioned below the first door 115, whereas the second control panel 313 of the second treatment apparatus L is positioned above the second door 315.

When the first treatment apparatus T is mounted on the second treatment apparatus L in order to efficiently utilize the space in which the laundry treatment apparatus is installed, there may be a problem in that it is difficult to input control commands to the first treatment apparatus T by user key manipulation if the control panel 113 of the first treatment apparatus T is positioned at an upper portion of the first cabinet 1 (above the first door 115). Accordingly, the first control panel 113 is preferably disposed at a lower portion of the first cabinet 1.

In the case in which the second treatment apparatus L is provided as an apparatus for drying laundry, the second container may be constituted by only the second drum, which is disposed in the second cabinet 3 to accommodate laundry therein.

The second drum 5 may be configured to have a cylindrical shape, which is open at the front and rear surfaces thereof. In this case, the second cabinet 3 may be provided therein with a front support for rotatably supporting the front surface of the second drum, and a rear support for rotatably supporting the rear surface of the second drum.

Figure 15A:
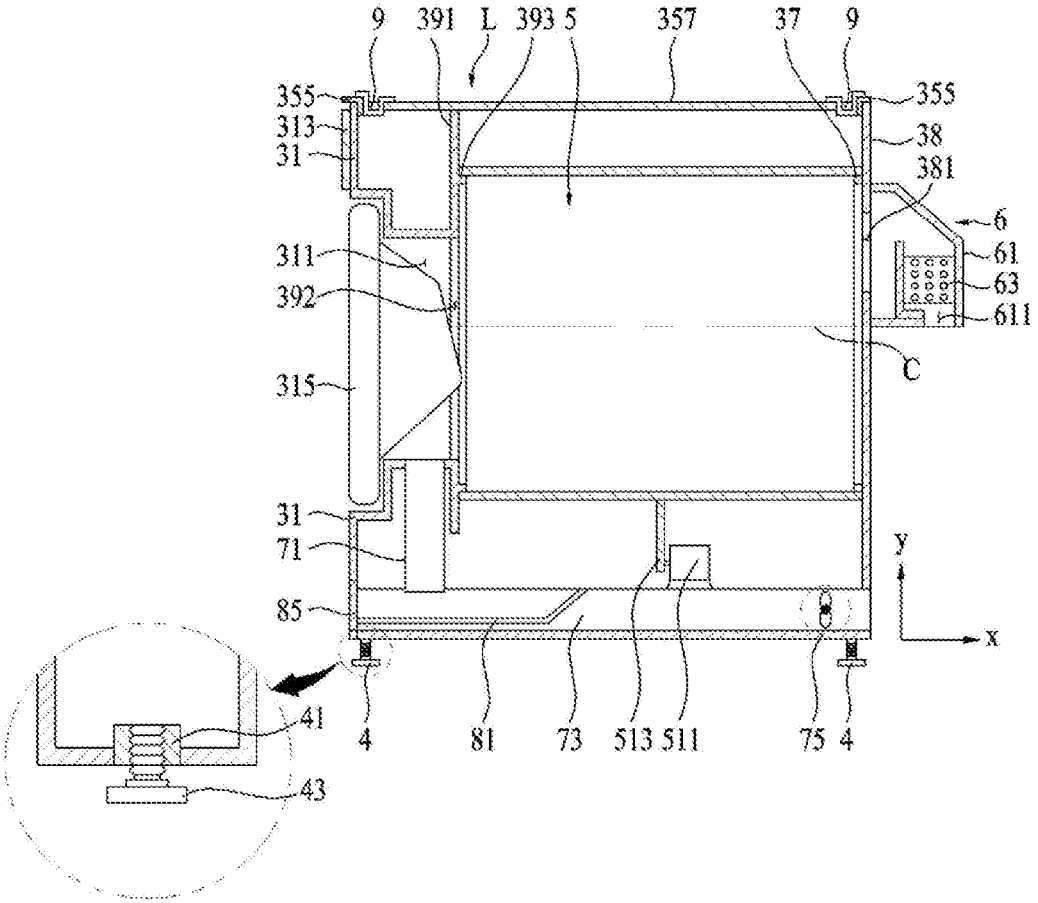
Figure 15B:
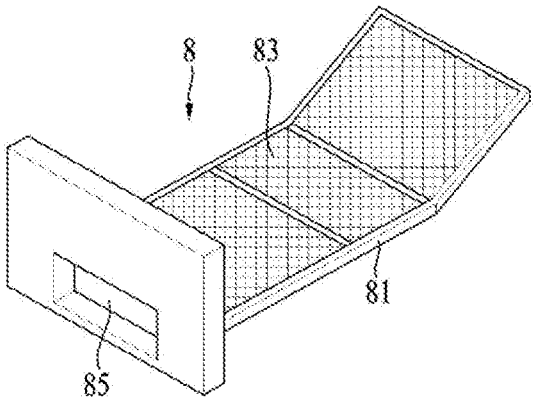

As shown in FIG. 15, the front support may include a support body 391 secured in the second cabinet 3, a communication hole 392, which is formed through the support body 391 so as to communicate with the second introduction port 311, and a front flange 393, which protrudes from the support body 391 so as to support the open front surface of the second drum 5.

The rear support 37 may be constituted by a rear flange, which protrudes from the rear panel 38 of the second cabinet 3 so as to support the open rear surface of the second drum 5.

The second drum 5 is rotatable by a second drive unit 51. The second drive unit may include a motor 511 and a belt 513 for connecting the rotating shaft of the motor 511 to the outer circumferential surface of the second drum 5.

The second drum 5 receives air heated by a second air supply unit 6, and the air inside the second drum 5 is discharged to the outside of the second cabinet 3 through a second air discharge unit.

The second air supply unit 6 may include a housing 61, which is disposed at the rear panel 38 so as to allow a housing introduction opening 611 and an air introduction opening 381, formed in the rear panel, to communicate with each other, and a heater (heating unit) 63, which is disposed in the housing 61.

The second air discharge unit may include a connecting duct 71, which is disposed in the height direction Y of the second drum 5, a discharge duct 73, which is disposed in the lengthwise direction X of the second drum 5 so as to discharge air, supplied from the connecting duct 71, to the outside of the second cabinet 3, and a fan 75, which is disposed in the discharge duct 73.

The discharge duct 73 may be provided with a second filter unit 8 for filtering air introduced from the connecting duct 71.

The second filter unit 8, which is provided in the laundry treatment apparatus, is characterized by being disposed in the discharge duct 73 rather than the connecting duct 71 so as to filter air discharged from the second drum 5.

It is preferable that the second filter unit 8 is removably mounted in the discharge duct 73 through the front panel 31.

To this end, the front panel 31 may be provided with a duct communication hole 317 (see FIG. 14), which allows the discharge duct 73 to communicate with the front panel 31, and the second filter unit 8 may include a handle 85, which is detachably mounted in the duct communication hole 317, a filter frame 81, which is secured to the handle 85 and extends toward the discharge duct 73, and a filter 83, which is disposed at the filter frame 81 so as to filter air.

When the first treatment apparatus T serves as an apparatus for performing a laundry drying operation, the first container, the first air supply unit, the first air discharge unit and the first filter unit, which are provided in the first treatment apparatus T, may have the same structures as the second container 5, the second air supply unit 6, the second air discharge unit and the second filter unit 8, which are provided in the second treatment apparatus L.

When the second treatment apparatus L serves as an apparatus for performing a laundry washing operation, the second container 5 shown in FIG. 15 may include a second tub and a second drum, which is rotatably disposed in the second tub.

In this case, the second tub may be configured to have the shape of a cylinder having a tub introduction port communicating with the second introduction port 311, and the second drum may be configured to have the shape of a cylinder having a drum introduction port communicating with the tub introduction port. Furthermore, the second drive unit 51 may include a rotating shaft, which extends through the second tub and is connected to the second drum, a stator secured to the second tub, and a rotor, which is secured to the rotating shaft and is rotated by a rotational magnetic field generated from the stator.

Furthermore, the second treatment apparatus L should be provided with a second water supply unit for supplying water to the second tub, and a second water discharge unit for discharging the water stored in the second tub.

When the second treatment apparatus L serves as an apparatus for performing both laundry drying and washing operations, the second container may be constituted by the second tub and the second drum, and the second cabinet may include therein a first water supply unit for supplying water to the second tub, a second water discharge unit for discharging the water, a second air supply unit for supplying air to the second tub, and a second air discharge unit for discharging the air inside the second tub to the outside of the second cabinet.

When the first treatment apparatus T is mounted on the second treatment apparatus L, which is constructed to have only the above-described structure, there may be the following problem.

Firstly, there may be a problem in that the upper panel 35 of the second treatment apparatus L is broken or the appearance thereof is damaged when the height of the first treatment apparatus T or the horizontal state of the first treatment apparatus T is adjusted.

Since the bottom surface of the first treatment apparatus T is provided with at least 14 first control devices 15, the height or horizontal state of the first treatment apparatus T may be adjusted by rotating the control bodies 153 of the first control devices 15. However, if there is no structure to support the control bodies 153 on the upper panel 35 of the second treatment apparatus, the upper panel 35 may break due to the load of the first treatment apparatus T, and the appearance of the upper panel 35 may be damaged upon rotating the control bodies 153.

Furthermore, a gap, which corresponds to the length of the control bodies 153, is defined between the bottom surface of the first treatment apparatus T and the upper panel 35 of the second treatment apparatus L. This gap, defined between the bottom surface of the first treatment apparatus T and the upper panel 35 of the second treatment apparatus L, may deteriorate the aesthetic appearance of the laundry treatment apparatus, and pollutants may accumulate in the space between the first laundry treatment apparatus and the second laundry treatment apparatus, which deteriorates sanitation not only of the laundry treatment apparatus but also of the space in which the laundry treatment apparatus is installed.

The above-mentioned problem may be solved by forming holes in the upper panel 35 and fitting the control bodies 153 of the first treatment apparatus. However, in this case, the height of the first treatment apparatus cannot be controlled by the control bodies 153 provided in the first treatment apparatus, and the aesthetic appearance of the second treatment apparatus may be deteriorated due to the holes formed in the upper panel of the second treatment apparatus when the first treatment apparatus is removed from the second treatment apparatus (making it difficult to install the second treatment apparatus along).

In addition, when holes are formed in the upper panel 35 of the second treatment apparatus and the control bodies 153 of the first treatment apparatus are fitted in the holes, there is a need to provide additional fastening members for coupling the first treatment apparatus and the second treatment apparatus with each other. However, since the control panels 113 and 313 are disposed on the front faces of the first and second treatment apparatuses, the rear surfaces of the first and second treatment apparatuses have to be coupled to each other by the fastening members, and the first and second treatment apparatuses are not firmly coupled to each other.

In order to solve these problems, the second treatment apparatus L may further include support members 9, which are provided at the upper panel 35 to support the first control devices 15 of the first treatment apparatus.

The number of support members 9 is preferably set to correspond to the number of first control devices 15 provided at the first treatment apparatus. FIG. 14 illustrates an example in which four support members 9 are provided in such a manner as to dispose two support members 9 on the front area of the upper panel 35 and to dispose two support members 9 on the rear area of the upper panel 35.

Figure 16:
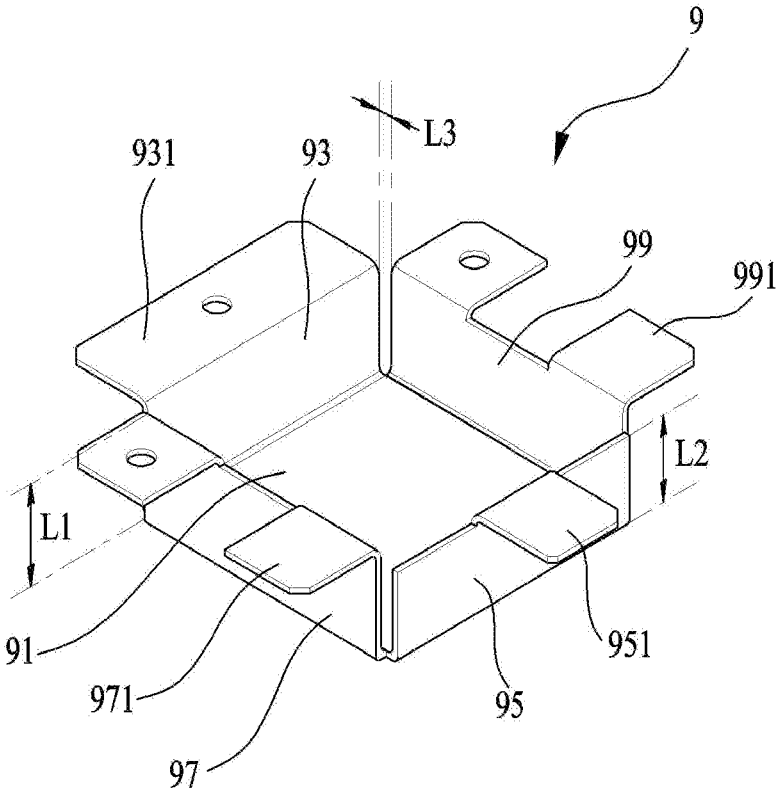
FIGS. 16 and 17 are views showing an example of a support member.

As shown in FIG. 16, each of the support members 9 may include a base 91, on which the control body 153 of the first control device is placed, and frames 93, 95, 97 and 99, which serve to secure the base 91 to the upper panel 35.

As described above, the smaller the distance between the first treatment apparatus T and the second treatment apparatus L, the better. Accordingly, it is preferable for the upper panel 35 to be provided with through holes 351 formed therethrough and for the base 91 to be fitted into the through holes 351 so as to be positioned lower than the upper panel 35.

The shape of the base 91 and the number of frames may be determined in accordance with the shape of the through holes 351. FIG. 16 illustrates an example in which the support member 9 is fitted into the through hole 351 having a rectangular shape.

FIG. 16 illustrates the support member 9 in which the first frame 93, the second frame 95, the third frame 97 and the fourth frame 99 are provided at respective sides of the base 91, which has a rectangular shape.

In this case, the respective frames 93, 95, 97 and 99 are preferably spaced apart from each other by a predetermined distance L3. When the first container is rotated by the first drive unit of the first treatment apparatus T, vibrations of the first container are transferred to the first cabinet 1. Accordingly, when the respective frames 93, 95, 97 and 99 are kept spaced apart from each other by a predetermined distance, vibrations, which are transferred from the first treatment apparatus T to the second treatment apparatus L through the control bodies 153, may be efficiently diminished.

The frames 93, 95, 97 and 99 are respectively provided with a first frame flange 931, a second frame flange 951, a third frame flange 971 and a fourth frame flange 991, which serve to connect the base 91 to the upper panel 35.

Each of the frame flanges 931, 951, 971 and 991 may be provided with fastening holes through which fastening members such as bolts are inserted.

Since the load of the first treatment apparatus T is concentrated on the support member 9, the upper panel 35 has to meet or exceed a predetermined strength and rigidity. To this end, the upper panel 35 may include a stepped portion 355, by which two surfaces 353 and 357 having different heights are defined.

Specifically, as shown in FIG. 14, the upper panel 35 may include a first surface 355 formed at the circumferential area thereof, and a second surface 357, which is disposed at a lower level than the first surface 355 by the stepped portion 353.

In this case, the base 91 is preferably mounted on the upper frame 35 in such a manner as to secure the frames 93, 95, 97 and 99 of the support member to the first surface 355.

Figure 17:
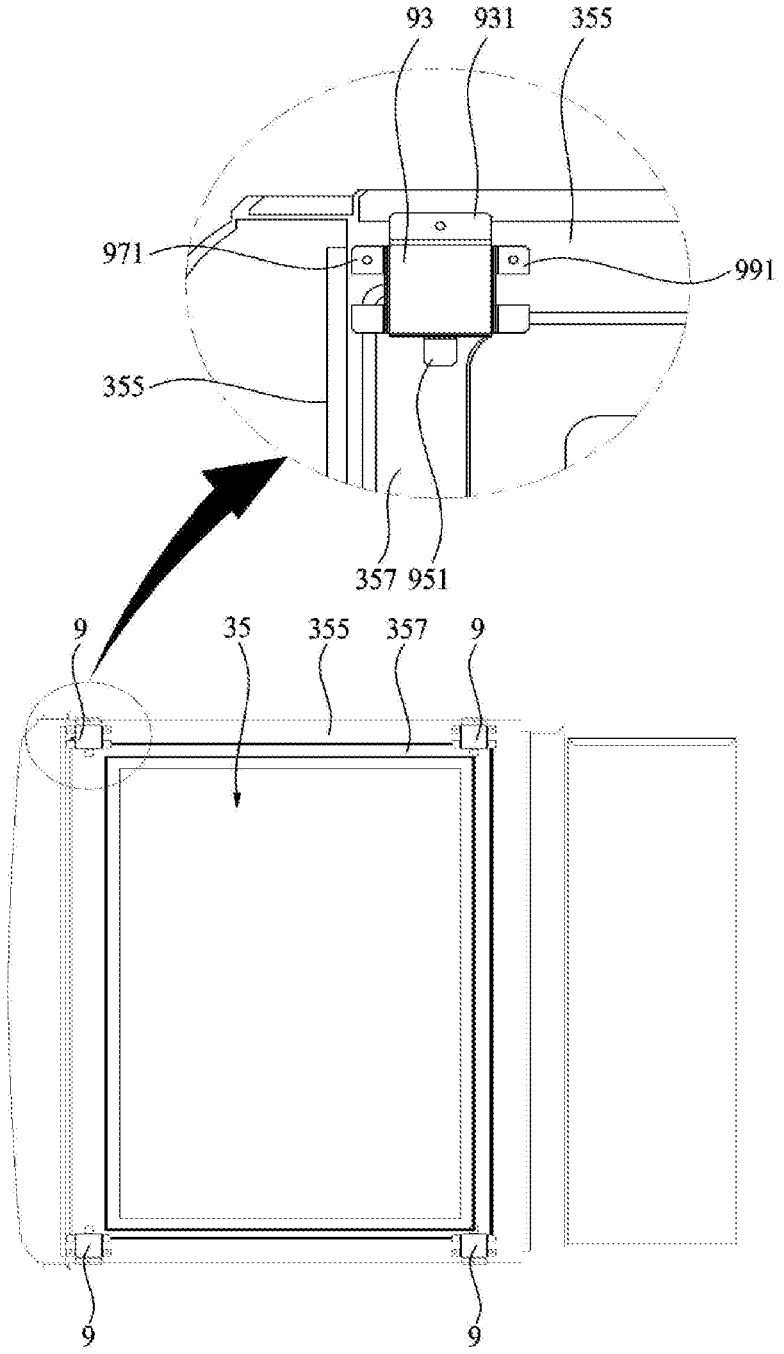

FIG. 17 illustrates an example in which the support member 9 having four frames 93, 95, 97 and 99 is coupled to the upper panel 35. In this case, the first frame 93, the third frame 97 and the fourth frame 99 serve to secure the base 91 to the first surface 355, and the second frame 95 serves to secure the base 91 to the second surface 357. Accordingly, the height L2 of the second frame 95 may be lower than the height L1 of the first frame 93.

Since the first surface 355 is provided along the circumferential region of the upper panel 35 and the circumferential region of the upper panel 35 is supported by the front panel 31, the rear panel 38 and the like, the support member 9 may more securely support the first treatment apparatus T by coupling the base 91 to the first surface 355.

Furthermore, when the second treatment apparatus L is provided with a panel frame for supporting the upper panel 35, the panel frame may be disposed to support the first surface 355 from below. Accordingly, when the base 91 is supported by the first surface 355, the support member 9 may support the first treatment apparatus T more securely.

In the laundry treatment apparatus equipped with the support members 9, even when the control body 153 of the first control device is rotated after the first treatment apparatus T is mounted on the second treatment apparatus L, there is no risk of the upper panel 35 of the second treatment apparatus breaking or the appearance of the upper panel 35 being marred. Furthermore, since the base 91, on which the control body 153 is placed, is disposed at a level lower than the upper panel 35, it is possible to minimize the distance between the first treatment apparatus T and the second treatment apparatus L.

In some implementations, the through holes 351 may be configured to have a circular or polygonal shape. In any case, the base 9 may be configured to have any shape capable of allowing the base 91 to be fitted into the through hole 351, and the frames are preferably disposed along the outer circumference of the base 91 and spaced apart from each other by a predetermined distance.

In addition, although the above example has been described based on the case in which the second treatment apparatus L, which is different from the first treatment apparatus T, supports the first treatment apparatus T, the laundry treatment apparatus may be embodied in such a manner that one second treatment apparatus L supports another second treatment apparatus L. In this case, the second treatment apparatus L may be provided at the bottom surface thereof with second control devices 4 shown in FIG. 15.

The second control device 4 may include a fixing body 41, fixed to the bottom surface of the second treatment apparatus L, and a control body 43, which is rotatably provided in the fixing body 41 so as to control the height of the second treatment apparatus L by adjusting the rotational angle thereof and which is received in the space defined by the respective frames 93, 95, 97 and 99.

Although implementations have been illustrated and described above, it will be apparent to those skilled in the art that the implementations are provided to assist understanding of the present disclosure and the present disclosure is not limited to the above described implementations. Various modifications and variations can be made without departing from the spirit or scope of the present disclosure.

What is claimed is:

1. A laundry treatment apparatus comprising:

a cabinet defining an appearance of the laundry treatment apparatus;

a drum provided in the cabinet and configured to hold laundry;

a connecting duct configured to communicate with the drum;

a lint filter unit that is mounted to an inner surface of the cabinet, that is accessible from a front surface of the cabinet, and that is configured to communicate with the connecting duct to filter pollutants; and a lock unit configured to selectively lock the lint filter unit to the connecting duct, wherein the lock unit comprises:

a rotatable lock body; and a lock guide that has a guide hole through which a shaft extends, and that is configured to be connected to the lock body through the shaft, and that is configured to be rotated by the lock body;

wherein the lock guide comprises:

a first body that is configured to extend parallel to a front portion of the link filter unit; and a second body that has a first bent section, wherein the first bent section is configured to protrude from the first body toward the front portion of the lint filter unit.

2. The laundry treatment apparatus according to claim 1, wherein a bent section is configured to be in surface contact with an inner surface of the connecting duct to restrict the lint filter unit from being withdrawn from the front surface of the cabinet based on the lock guide being inserted in the connecting duct when rotated.

3. The laundry treatment apparatus according to claim 1, wherein the second body comprises:

a second bent section configured to extend from the first bent section in a same direction as the direction the first body of the lint filter unit is configured to extend.

* * * * *